US005277719A

United States Patent [19]

Kuhlman et al.

[11] Patent Number: 5,277,719

[45] Date of Patent: Jan. 11, 1994

[54] ALUMINUM ALLOY THICK PLATE PRODUCT AND METHOD

[75] Inventors: G. William Kuhlman, Cleveland, Ohio; Paul E. Magnusen, Plum Boro; Paul L. Mehr, Lower Burrell, both of Pa.; Dell F. Skluzak, Huntington Beach, Calif.; Andrew C. Spitznas, Davenport, Iowa; Paul T. Wang, Murrysville; Charles J. Warren, Sarver, both of Pa.; Kenton P. Young, Davenport; John A. Schelin, Bettendorf, both of Iowa

[73] Assignee: Aluminum Company of America, Pittsburgh, Pa.

[21] Appl. No.: 968,787

[22] Filed: Oct. 30, 1992

Related U.S. Application Data

[63] Continuation-in-part of Ser. No. 687,328, Apr. 18, 1991, abandoned.

[51] Int. Cl.[5] ..... C22F 1/04

[52] U.S. Cl. ..... 148/694; 148/689; 148/691; 148/695; 148/701; 148/702; 148/417; 148/439

[58] Field of Search ..... 148/689, 691, 694, 695, 148/701, 702, 417, 439; 420/532

[56] References Cited

U.S. PATENT DOCUMENTS 3,836,405 9/1974 Staley et al. ..... 148/695
3,839,019 10/1974 Bruno et al. ..... 75/681

OTHER PUBLICATIONS

J. T. Staley, "Investigation to Improve the Stress-Corrosion Resistance of Aluminum Aircraft Alloys Through Alloy Additions and Specialized Heat Treatment", Alcoa Research Laboratories Final Report, Naval Air Systems Command Contract N00019-6-8-C-0146, Feb. 28, 1969.

*Primary Examiner*—R. Dean
*Assistant Examiner*—Robert R. Koehler
*Attorney, Agent, or Firm*—Gary P. Topolosky; Carl R. Lippert

[57] ABSTRACT

Disclosed is a method of producing a forged and rolled Al-Zn-Cu-Mg alloy plate product having improved fatigue properties in the long transverse direction. The method comprises providing a body of an Al-Zn-Cu-Mg alloy, working said body by a forging operation to reduce its thickness in a C direction by at least 30% and rolling or working the forged body to provide a forged and rolled plate product having improved fatigue properties in the long transverse direction.

166 Claims, 2 Drawing Sheets

ALUMINUM ALLOY THICK PLATE PRODUCT AND METHOD

This application is a continuation-in-part of U.S. application Ser. No. 07/687,328, filed Apr. 18, 1991,now abandoned.

INTRODUCTION

This invention relates to aluminum alloy plate products and more particularly to 7000 Series Aluminum Alloy plate having improved fatigue properties.

In aluminum alloy plate, particularly thick plate of about 3 inches or greater, fatigue properties tend to diminish especially when compared to their thin plate counterparts. This lower level of fatigue strength of thick plate product could result in a weight disadvantage for aircraft and unfavorable payloads thereby affecting the economic use of such thick plate product. It is desirable to maximize the fatigue properties of thick plate product without adversely affecting its other properties such as tensile strength and ductility.

SUMMARY OF THE INVENTION

It is a principle objective of this invention to provide an aluminum alloy thick plate product having improved fatigue strength.

It is a further objective to provide thick aluminum alloy plate product having improved he short and long transverse directions.

It is another objective to provide a process for producing thick aluminum alloy plate product having improved fatigue strength and elongation in the short transverse direction.

It is still another objective to provide thick plate product from 7000 Series aluminum alloys which are capable of exhibiting an increased fatigue life when subjected to smooth axial, edge notched or open hole testing. These and other objectives will become apparent from the specification and claims appended hereto.

In accordance with these objectives, there is provided a method of producing thick plate product from an Al-Zn-Cu-Mg alloy, said plate product having improved fatigue properties in the long transverse direction . The method comprises providing an Al-Zn-Cu-Mg aluminum alloy body, pre-working said body by forging in an amount sufficient to decrease the microvoid fraction therein, and rolling or working the forged body to provide a thick plate product having improved fatigue properties in the long transverse direction when measured in accordance with ASTM test method E-466, the disclosure of which is fully incorporated by reference herein

DETAILED DESCRIPTION OF THE PREFERRED EMBODIMENTS

Figure 1:
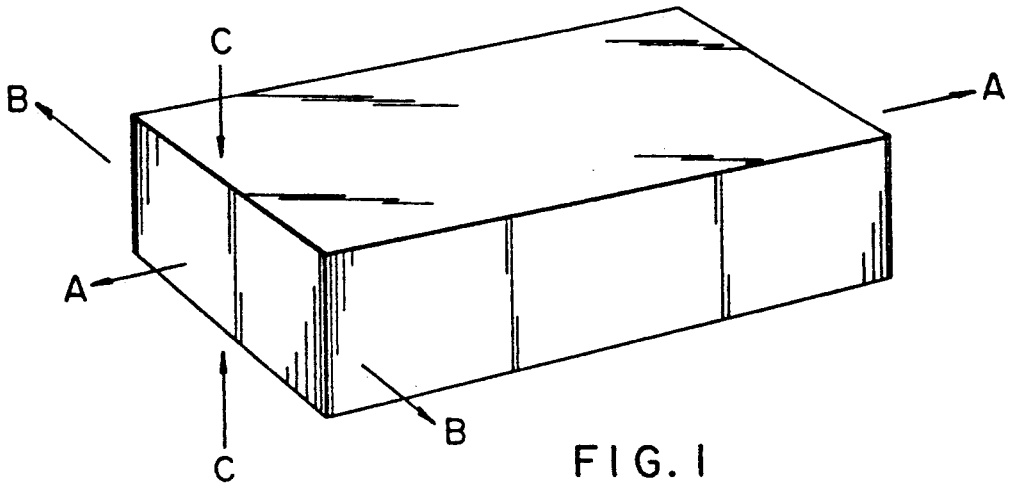
FIG. 1 shows an ingot and directional nomenclature.

When numerical ranges are stated for any compositional element, processing temperature, alloy product property, percent reduction or other aspect of this invention, such ranges are expressly intended to include each and every number, including fractions and/or decimals, from the stated range minimum to its stated range maximum For example, about 5–8% zinc includes zinc levels of 5.5, 6%, 7% . . . and so on up to the stated range maximum. Likewise, percent reductions of at least 30% would include reductions of 35%, 40%, 43%, and 48%, to name a few.

ASTM test method E-466 referred to herein uses a smooth round specimen 0.5 inch in diameter (as opposed to a notched specimen) loaded at 35 ksi stress with a stress ratio of 0.1 and frequency of 10 Hz.

The term "cumulative failure percent", as used herein, means the fatigue lifetimes for a number of specimens tested in the same manner Such lifetimes are described as the cumulative percent of all test specimens which have failed due to fatigue at a particular number of fatigue test cycles.

Aluminum base alloys processed according to the present invention can contain about 1 to 3 wt. % Cu, about 0.9 to 2.85 wt. % Mg, about 1 to 9.5 wt. % Zn, preferably about 5 to 8 wt. % Zn, max. 0.5 wt. % Mn, max. 0.3 wt. % Cr, max. 0.3 wt. % Zr, max. 0.3 wt. % V, max. 0.3 wt. % Hf, the remainder aluminum, incidental elements and impurities When iron and silicon levels are low, i.e., up to about 0.06% Fe and up to about 0.04% Si, it is believed that even greater fatigue lifetimes will be experienced. Preferred impurity levels of about 0.01 or 0.02 to 0.05 wt. % Fe and about 0.01 to 0.03 wt. % Si are believed to impart substantial increases of possibly two to three times greater open hole test fatigue lifetimes as compared to their non-forged counterparts. For some alloys, Zn may be maintained from about 8 to 9.5 wt. %. When Mn, Cr or Zr are present, normally the lower limit of each is not less than 0.04 or 0.05 wt. %.

Thick plate product can be made according to the invention from aluminum alloys including Aluminum Association (AA) alloy designations: 7049, 7149, 7050, 7150, 7064, 7075, 7175, 7475, 7076 and 7178. Preferred alloys include AA 7050, 7150, 7075 and 7175 aluminum. In addition, 2000 Series, 6000 Series and 8000 Series aluminum alloys can also be processed in accordance with this invention.

In melting and transferring aluminum alloys for casting into ingot, a considerable amount of impurity is often introduced into the melt. These impurities include gases, such as hydrogen from moisture in the atmosphere. Gases in the solidified metal result in ingot porosity. Porosity may also result from shrinkage of the ingot upon solidification. Such porosity is present as micropores which can have a cross-sectional extent ranging from 10 to 500 μm. The term "extent" is used herein to describe the longest dimension across these micropore cross-sections since the pores are not often circular but rather irregularly shaped.

Porosity can account for up to 0.5% of an ingot's volume. Such porosity is believed to lower fatigue life, particularly in the long and short transverse directions (or B and C directions of FIG. 1, respectively), of plate product which is usually about 3 to 10 inches thick. In theory, these pores act as sites for fatigue cracks to initiate. Thus, it is desirable to reduce the porosity in the plate of this invention to as low a level as possible, e.g., to not greater than about 0.05% for 3 to 6 inch plate, and as high as 0.1% for plate 6 to 10 inches thick.

In order to reduce ingot porosity, it is beneficial to subject the molten aluminum from which an ingot will be cast to an effective degassing operation for minimizing the amount of hydrogen present in the melt. Effective degassing techniques are disclosed in U.S. Pat. No. 3,839,019, the disclosure of which is fully incorporated by reference herein, although it is to be understood that other known or subsequently developed degassing processes may be substituted therefor.

After degassing, the aluminum melt can be provided as an ingot or billet for fabricating into suitable wrought product by techniques currently employed in the art. Continuous casting processes are especially preferred in this regard. The ingots that are produced can be round, rectangular or square in cross section. For purposes of nomenclature, the length of an ingot is herein referred to as the A direction, the width as the B direction and thickness as the C direction, as shown in FIG. 1. For a round or square ingot, the B and C dimensions are obviously the same and thus considered equivalent. The long transverse direction referred to herein is the same as the ingot's B direction.

Figure 2:
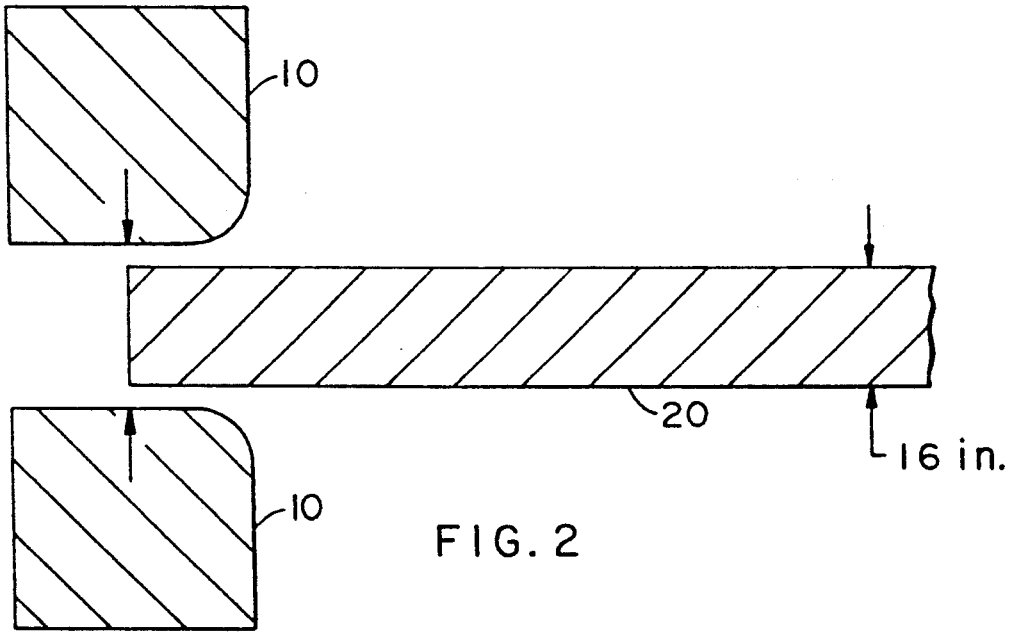
FIG. 2 shows an ingot forging operation in accordance with the present invention.
Figure 3:
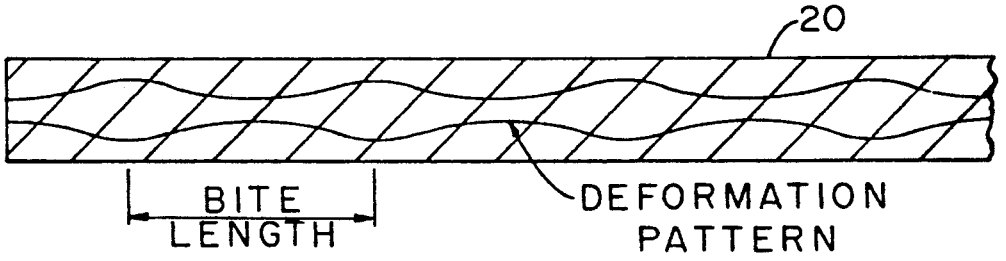
FIG. 3 shows an ingot after a first forging pass with the metal deformation resulting from said pass.

The ingot is preferably subjected to homogenization, and preferably at metal temperatures in the range of about 800 to 1100° F. for at least one hour Such treatment is believed to dissolve soluble constituents and homogenize the internal structure of the metal Homogenization times of two hours or more within the homogenization temperature range are even more preferred. Normally, heatup and homogenizing treatment does not have to extend for more than 24 hours Longer homogenization times are not normally detrimental, however. A time of 3 to 36 hours at the homogenization temperature has been found to be quite suitable For example, a typical homogenization treatment extends for about 12 hours at 800° F. In addition to dissolving constituents to promote formability, such homogenization treatments are believed to coalesce any undissolved constituents such as those formed by iron and silicon This coalescence aids in providing the present alloy with superior formability For producing thick plate with improved fatigue properties in the short or long transverse directions, ingots of this invention are next subjected to a forging operation prior to rolling or working. Each ingot may be scalped prior to this forging operation. For purposes of forging, the ingots are first heated in the temperature range of about 600° to 900° F. During this forging operation wherein the ingots are preferably deformed or squeezed in the C direction to provide a billet, they are preferably not permitted to cool below about 500° F. The ingots may also be deformed in the B direction after C direction deformation, in the B direction alone, or in the B direction followed by C direction deformation. Such forging operations are carried out until the thickness of the ingot is reduced by 5 to 80% of its original thickness. This reduction in thickness may be accomplished in one pass of ingot 20 between dies 10 (see FIG. 2) of the forging press or several passes may be made. Preferably, the forging reduction in thickness ranges from about 30 or 35, 40 or 45% to about 60 or 65 to 70% of the original thickness, with typical reductions ranging from about 43 to 57%.

Figure 4:
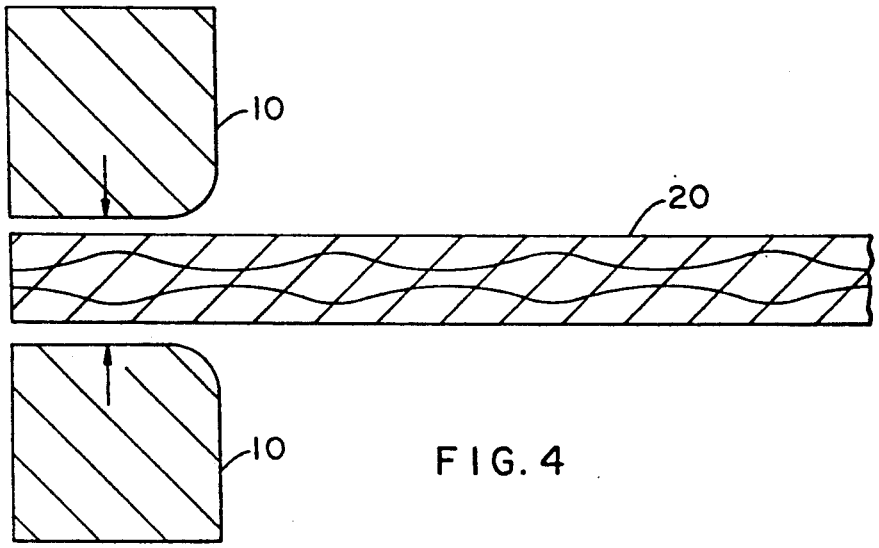
FIG. 4 shows the alignment of press dies for a second forging pass.
Figure 5:
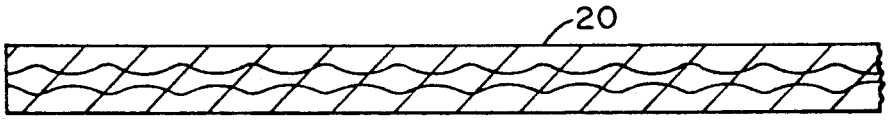
FIG. 5 is an ingot schematic showing metal deformation after a second forging pass.

If more than one forging pass is used, the depth of bite of one pass may be more than the depth of another pass. For example, the first bite pass can be deeper than the second. In one preferred embodiment, it is preferred that the first forging bite pass be deeper than the second bite pass. The deeper bite pass preferably reduces ingot thickness by about 10 to 40% of its original thickness. The shallower second bite pass that follows preferably reduces the thickness of the already reduced ingot by an additional 5 to 30%. It is preferred to maintain the same bite length along the entire ingot in any given forging pass. When ingots are subjected to a second forging reduction, the second forging deformation should not be superimposed directly over that of the first deformation reduction. Rather, it should be moved or offset by about one half the bite length of the previous pass to further control and minimize distortion of the grain flow or deformation pattern from the forging operation, thereby increasing micropore healing and improving final plate product property uniformity. Dies 10 of FIG. 4 are positioned to operate on the section of least distortion in the first forging pass to provide uniform working of the ingot interior as shown in FIG. 5.

The leading edge of each forging press die 10 is provided with a radius sufficient that overlapping of the aluminum does not occur on the next pressing or forging operation. Die radius is typically controlled to be not less than 100% of the bite depth into the ingot. If the bite depth is 3 inches, then the radius should be not less than about 4 inches.

After forging or preworking, the resulting forged billet may be subjected to homogenization, as noted, or simply preheated to a temperature in the range of about 500° to 900° F. prior to hot rolling. Preferably, the forged ingot is hot rolled to provide a preforged plate product whose thickness ranges from about 3 to 10 inches. The term "preforged plate product", as used herein, means plate which has been subjected to a forging operation prior to further working or rolling. The hot rolling should be controlled to further provide a reduction in the range of about 5 to 75% of preworked billet thickness, or preferably about 5 to 40% when about 3- to 5-inch thick plate is desired and about 5 to 50% when about 5- to 10-inch thick plate is desired. "Billet" as used herein, refers to ingot which has been forged to an intermediate thickness and/or width dimension.

While it is preferred to hot roll the preforged billet to provide a plate, it is contemplated within the purview of this invention that preworked billet be further forged or worked to provide a final plate product without rolling. Thereafter, the ingot, forged to plate dimensions, can be solution heat treated, quenched, stretched and aged as noted for use as improved plate product.

After rolling or working preforged ingot body to the desired thickness, the plate is solution heat treated to substantially dissolve soluble constituents. Such solution heat treatment is preferably accomplished at one or more temperatures in the range of about 800° to 1000° F. Solution effects can basically occur in as little as ¼ to 6 hours once the metal has reached a proper solution temperature. Accordingly, the inventors contemplate solution heat treating in about 5 hours or less, for instance about ¼ to 4 hours.

After solution heat treatments, this alloy product should be rapidly quenched to further provide for the desired properties necessary in the final plate product. Suitable rates can be obtained through water quenching. For purposes of relieving residual stress, plate product of this invention can also be stretched by about 0.5 to 4.5% of its original length. After stretching, this plate is artificially aged, the times and temperatures for such aging being selected based on what is best suited for the particular alloy being used. Such plate may thus be aged by a one-step process or any suitable multi-step aging practices compatible for that alloy.

Figure 6:
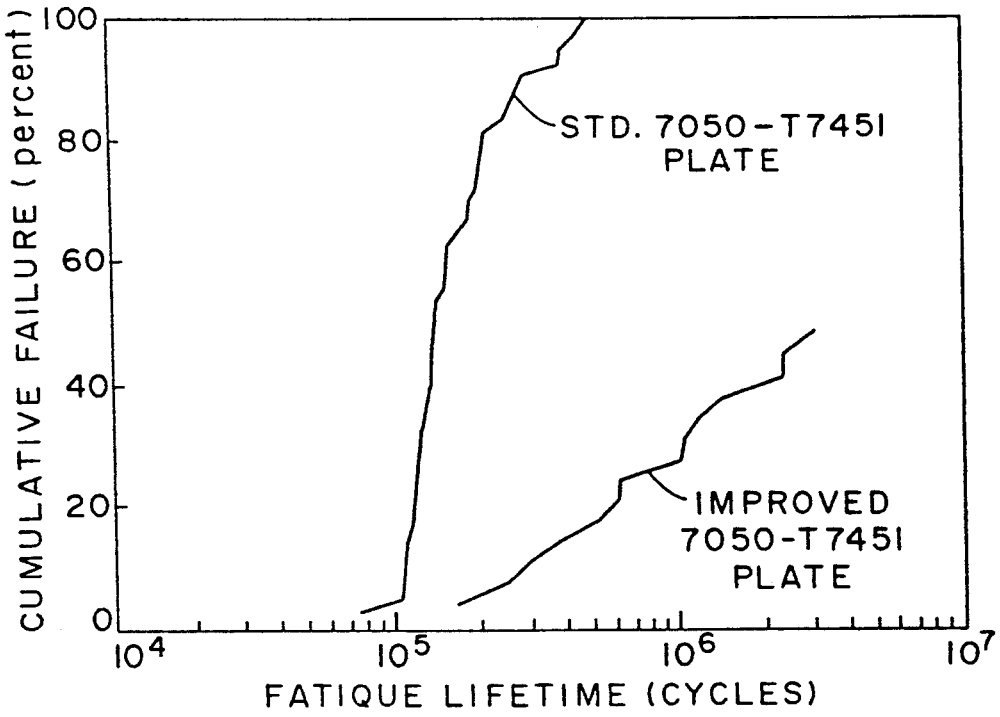
FIG. 6 is a graph showing the improvement in fatigue lifetime in the long transverse grain direction of AA7050-T7451 plate under cyclic loading pursuant to ASTM test method E-466, with cumulative failure percent plotted along the x-axis versus fatigue lifetime (cycles to failure) along the y-axis

Thus, it will be seen that the present process provides thick plate, e.g., from about 3, 4, 5 or 6 inches thick to about 9 or 10 inches thick, having improved fatigue properties in the short and/or long transverse directions, together with improved elongation in the short transverse direction and no loss in other properties. Typically, elongations of at least about 3% in the short transverse direction can be imparted to plate products through the practice of this invention. Plate in accordance with this invention can also have long transverse fatigue lives of at least $1.25\times10^5$ cycles at a cumulative failure of 5% which means that only 5% of all specimens tested failed at that minimum cycle level. At a cumulative failure from up to about 5% to about 50%, as shown in FIG. 6, plate products of this invention can exhibit fatigue lives ranging from $1.25\times10^5$ to $2\times10^6$ cycles. While forging has been used as noted to provide such remarkable improvements on fatigue life, it will be appreciated that other kinds of ingot deformations to improve fatigue life are also contemplated within the purview of this invention. For example, several layers of thin plate may be metallurgically bonded together to provide thick plate having improved fatigue life.

EXAMPLE

Two lots of 7050 aluminum were prepared containing an average melt form composition of 6.1 wt. % Zn, 2.2 wt. % Cu, and 2.2 wt. % Mg as their principle alloying components. Other elements present were 0.05 wt. % Si, 0.11 wt. % Fe and 0.008 wt. % Mn (all below the Aluminum Association 7050 alloy maximums of 0.12% Si, 0.15% Fe and 0.1% Mn listed for these elements). Each lot was subjected to degassing before being cast into an ingot measuring 16"×55"×135". The ingot was homogenized at 890° F. for 28 hours and thereafter scalped to provide a thickness of 14.5 inches. The scalped ingot was then heated to 700° F. and forged by deforming in the C direction beginning at one end working to the opposite end in 10-inch long bites. In this operation, the ingot was drawn down from 14½ inches to 11 inches. The 11-inch thick billet was then subjected to a second forging where it was reduced to 9 inches thick with 11-inch long bites offset from the first pass by a half bite length. The 9-inch thick ingot was reheated to 890° F. and then hot rolled, starting at a temperature of 825° F., to produce 5.7-inch thick plate thereby. This plate was solution heat treated at 890° F. for 140 minutes, cold water quenched and stretched to 1.9% of its original length before artificially aging at 250° F. and 325° F. to produce thick 7050 plate in the T7451 temper. Samples were then cut from each lot of this plate in the long transverse direction for machining into fatigue test specimens and testing in accordance with ASTM test method E-466. The results of these tests are shown in FIG. 6. There, cumulative failure percentage versus cycles to failure for a plurality of specimens were plotted. Fatigue performance for specimens of standard quality, 5.7 inch thick 7050-T7451 plate (similarly prepared and tested) were then comparatively plotted in the same FIG. 6. It will be seen that specimens taken from the plate prepared in accordance with this invention have fatigue lives which are dramatically improved over those taken from plate prepared by standard fabrication methods, i.e., without forging Further representative properties for the two lots of 5.7-inch thick plate produced according to the invention are averaged as follows:

| Property | Long. | Long Trans. | Short Trans. |
|---|---|---|---|
| Tens. Ult. Strength, ksi | 75.3 | 74.7 | 72.2 |
| Tens. Yld. Strength, ksi | 67.0 | 65.1 | 61.9 |
| Elongation, % | 10.0 | 9.1 | 5.7 |
| Fract. Toughness, $K_{IC}$, ksi $\sqrt{in.}$ | 26.0 | 24.0 | 26.0 |

Improved fatigue properties, as well as improved short transverse elongation, are thus achieved with no appreciable effect on tensile strength properties according to this invention.

Having thus described the presently preferred embodiments, it is to be understood that the invention may be otherwise embodied by the scope of the appended claims.

What is claimed is:

1. A method of producing a thick plate product having good fatigue properties in the long transverse direction, said method comprising:
   (a) providing a body of an aluminum base alloy comprising: about 1 to 3 wt. % Cu, about 0.9 to 2.85 wt. % Mg, about 1 to 9.5 wt. % Zn, max. 0.5 wt. % Si, max. 0.5 wt. % Fe, max. 0.5 wt. % Mn, max. 0.3 wt. % Cr, max. 0.3 wt. % Zr;
   (b) forging to squeeze said body and reduce its dimension in a C direction by at least about 30%; and
   (c) rolling said body.

2. The method in accordance with claim 1 wherein the forging of step (b) includes two or more reduction passes, the first of which reduces the dimension of said body in the C direction by about 5 to 80%.

3. The method in accordance with claim 1 wherein the forging of step (b) includes two or more reduction passes, the first of which reduces the dimension of said body in the C direction by about 10 to 60%.

4. The method in accordance with claim 1 wherein said plate product has an elongation in the short transverse direction of at least about 3%.

5. The method in accordance with claim 1 wherein said body is one of the alloys selected from AA7049, 7149, 7050, 7150, 7064, 7075, 7175, 7475, 7076 and 7178.

6. The method in accordance with claim 1 wherein said body contains about 5 to 8 wt. % Zn.

7. The method in accordance with claim 1 wherein said body is forged in a temperature range of about 600° to 900° F.

8. A method of producing a thick plate product having improved fatigue properties in the long transverse direction, said method comprising:
   (a) providing a body of an aluminum base alloy comprising: about 1 to 3 wt. % Cu, about 0.9 to 2.85 wt. % Mg, about 5 to 8.5 wt. % Zn, max. 0.5 wt. % Si, max. 0.5 wt. % Fe, max. 0.5 wt. % Mn, 0.05 to 0.3 wt. % Zr;
   (b) forging to squeeze said body and reduce its thickness at least 30% in a C direction; and (c) rolling said body.

9. A method of producing a thick plate product having improved fatigue properties in the long transverse direction, said method comprising:

(a) providing a body of an aluminum base alloy comprising: about 1 to 3 wt. % Cu, about 0.9 to 2.85 wt. % Mg, about 5 to 8.5 wt. % Zn, max. 0.5 wt. % Si, max. 0.5 wt. % Fe, max. 0.5 wt. % Mn, 0.05 to 0.3 wt. % Zr;

(b) working said body by a forging operation which reduces said body at least 30% in a C direction;

(c) rolling said body; and (d) solution heat treating, quenching, stretching and aging said body.

10. A method of producing a thick plate product having improved fatigue properties in the long transverse direction, said method comprising:

(a) providing a body of an aluminum base alloy comprising: about 1 to 3 wt. % Cu, about 0.9 to 2.85 wt. % Mg, about 8 to 9.5 wt. % Zn, max. 0.5 wt. % Si, max. 0.5 wt. % Fe, max. 0.5 wt. % Mn, max. 0.3 wt. % Cr, max. 0.3 wt. % Zr;

(b) working said body by a forging operation which reduces said body at least 30% in a C direction; and (c) rolling said body.

11. A method of producing a thick plate product having improved fatigue properties in the long transverse direction, said method comprising:

(a) providing a body of an aluminum base alloy comprising: about 1 to 3 wt. % Cu, about 0.9 to 2.85 wt. % Mg, about 8 to 9.5 wt. % Zn, max. 0.5 wt. % Si, max. 0.5 wt. % Fe, max. 0.5 wt. % Mn, max. 0.3 wt. % Cr, max. 0.3 wt. % Zr;

(b) working said body by a forging operation which reduces said body at least 30% in a C direction;

(c) rolling said body; and (d) solution heat treating, quenching and aging said body.

12. The method in accordance with claim 11 wherein said plate product has improved fatigue properties in the short transverse direction.

13. A method of producing a thick aluminum alloy plate product having a fatigue life in the long transverse direction of at least $1.25\times10^5$ cycles at 35 ksi, said method comprising:

(a) providing a body of an aluminum base alloy comprising: about 1 to 3 wt. % Cu, about 0.9 to 2.85 wt. % Mg, about 1 to 9.5 wt. % Zn, max. 0.5 wt. % Si, max. 0.5 wt. % Fe, max. 0.5 wt. % Mn, max. 0.3 wt. % Cr, max. 0.3 wt. % Zr;

(b) working said body in a temperature range of about 600° to 900° F. by a forging operation which reduces said body at least 30% in a C direction, said forging operation including two or more reduction passes, the first of which reduces body thickness by about 10 to 60%; and (c) rolling said body starting in a temperature range of about 500° to 900° F. to provide a further reduction in thickness in the C direction of about 5 to 75%.

14. The method in accordance with claim 13 wherein said plate product has a fatigue life in the range of $1.25\times10^5$ to $2\times10^6$ cycles at 35 ksi and a cumulative failure of up to about 50%.

15. The method in accordance with claim 13 wherein said plate product has an elongation in the short transverse direction of at least about 3%.

16. The method in accordance with claim 13 wherein said body is one of the alloys selected from AA7049, 7149, 7050, 7150, 7064, 7075, 7175, 7475, 7076 and 7178.

17. The method in accordance with claim 13 wherein said body contains about 5 to 8 wt. % Zn.

18. A method of producing a thick plate product having a fatigue life in the long transverse direction of at least $1.25\times10^5$ cycles at 35 ksi, said method comprising:

(a) providing a body of an aluminum base alloy comprising: about 1 to 3 wt. % Cu, about 0.9 to 2.85 wt. % Mg, about 5 to 8.5 wt. % Zn, max. 0.5 wt. % Si, max. 0.5 wt. % Fe, max. 0.5 wt. % Mn, 0.05 to 0.3 wt. % Zr;

(b) working said body in a temperature range of about 600° to 900° F. by a forging operation which reduces said body at least 30% in a C direction, said forging operation including two or more reduction passes, the first of which reduces body thickness by about 10 to 60%; and (c) rolling said body starting in a temperature range of about 500° to 900° F. to provide a further reduction in thickness in the C direction of about 5 to 75%.

19. In a method of producing an aircraft structural member from thick aluminum alloy plate, the improvement wherein said plate is provided as an alloy body comprising: about 1 to 3 wt. % Cu, about 0.9 to 2.85 wt. % Mg, about 1 to 8.5 wt. % Zn, max. 0.5 wt. % Si, max. 0.5 wt. % Fe, max. 0.5 wt. % Mn, max. 0.3 wt. % Cr, max. 0.3 wt. % Zr, and said body is subjected to:

(a) working by a forging operation which reduces said body at least 30% in a C direction; and (b) rolling to provide a thick plate.

20. The improvement in accordance with claim 19 wherein the thick plate of step (b) has improved fatigue properties in the short transverse direction.

21. In a method of producing an aircraft structural member from thick aluminum alloy plate, the improvement wherein said plate is provided as an alloy body comprising: about 1 to 3 wt. % Cu, about 0.9 to 2.85 wt. % Mg, about 1 to 9.5 wt. % Zn, max. 0.5 wt. % Si, max. 0.5 wt. % Fe, max. 0.5 wt. % Mn, 0.05 to 0.3 wt. % Zr, and said body is subjected to:

(a) working by a forging operation which reduces said body at least 30% in a C direction; and (b) rolling to provide a thick plate.

22. The improvement in accordance with claim 21 wherein the thick plate of step (b) has improved fatigue properties in the short transverse direction.

23. In a method of producing an aircraft structural member from thick aluminum alloy plate, the improvement wherein said plate is provided as an alloy body comprising: about 1 to 3 wt. % Cu, about 0.9 to 2.85 wt. % Mg, about 5 to 9.5 wt. % Zn, max. 0.5 wt. % Si, max. 0.5 wt. % Fe, max. 0.5 wt. % Mn, 0.05 to 0.3 wt. % Zr, and said body is subjected to:

(a) working by a forging operation which reduces said body at least 30% in a C direction; and (b) rolling to provide a thick plate.

24. The improvement in accordance with claim 23 wherein the thick plate of step (b) has improved fatigue properties in the short transverse direction.

25. The improvement in accordance with claim 19 wherein the forging operation of step (a) includes two or more reduction passes, the first of which reduces the dimension of said body in the C direction by about 5 to 80%.

26. The improvement in accordance with claim 19 wherein the forging operation of step (a) includes two or more reduction passes, the first of which reduces the dimension of said body in the C direction by about 10 to 60%.

27. The improvement in accordance with claim 19 wherein the thick plate of step (b) has an elongation in the short transverse direction of at least about 3%.

28. The improvement in accordance with claim 19 wherein said body is one of the alloys selected from AA7049, 7149, 7050, 7150, 7064, 7075, 7175, 7475, 7076 and 7178.

29. The improvement in accordance with claim 19 wherein said body contains about 5 to 8 wt. % Zn.

30. The improvement in accordance with claim 19 wherein said body is worked in step (a) at a temperature range of about 600° to 900° F.

31. In a method of producing an aircraft structural member from thick aluminum alloy plate, the improvement wherein said plate is provided as an alloy body comprising: about 1 to 3 wt. % Cu, about 0.9 to 2.85 wt. % Mg, about 1 to 9.5 wt. % Zn, max. 0.5 wt. % Si, max. 0.5 wt. % Fe, max. 0.5 wt. % Mn, max. 0.3 wt. % Cr, max. 0.3 wt. % Zr, and said body is subjected to:

(a) working in a temperature range of about 600° to 900° F. by a forging operation which reduces said body at least 30% in a C direction, said forging operation including two or more reduction passes, the first of which reduces body thickness by about 10 to 60%; and (b) rolling starting in a temperature range of about 500° to 900 ° F. to provide a further reduction in thickness in the C direction of about 5 to 75% and produce a thick plate.

32. The improvement in accordance with claim 31 wherein the thick plate of step (b) has a fatigue life in the range of $1.25\times10^5$ to $2\times10^6$ cycles at 35 ksi and a cumulative failure of up to about 50%.

33. In a method of producing an aircraft structural member from thick aluminum alloy plate, the improvement wherein said plate is provided as an alloy body comprising: about 1 to 3 wt. % Cu, about 0.9 to 2.85 wt. % Mg, about 5 to 8.5 wt. % Zn, max. 0.5 wt. % Si, max. 0.5 wt. % Fe, max. 0.5 wt. % Mn, max. 0.3 wt. % Cr, max. 0.3 wt. % Zr, and said body is subjected to:

(a) working in a temperature range of about 600° to 900° F. by a forging operation which reduces said body at least 30% in a C direction, said forging operation including two or more reduction passes, the first of which reduces body thickness by about 10 to 60%; and (b) rolling in a temperature range of about 500° to 900° F. to provide a further reduction in thickness in the C direction of about 5 to 75% and produce a thick plate which has, after solution heat treating, quenching and aging, a fatigue life in the long transverse direction of at least $1.25\times10^5$ cycles at 35 ksi.

34. The improvement in accordance with claim 33 wherein the thick plate of step (b) has a fatigue life in the range of $1.25\times10^5$ to $2\times10^6$ cycles at 35 ksi and a cumulative failure of up to about 50%.

35. In a method of producing an aircraft structural member from thick aluminum alloy plate, the improvement wherein said plate is provided as an alloy body comprising: about 1 to 3 Cu, about 0.9 to 2.85 wt. % Mg, about 8 to 9.5 wt. % Zn, max. 0.5 wt. % Si, max. 0.5 wt. % Fe, max. 0.5 wt. % Mn, max. 0.3 wt. % Cr, max. 0.3 wt. % Zr, and said body is subjected to:

(a) working in a temperature range of about 600° to 900° F. by a forging operation which reduces said body at least 30% in a C direction, said forging operation including two or more reduction passes, the first of which reduces body thickness by about 10 to 60%; and (b) rolling to produce a thick plate which has, after solution heat treating, quenching and aging, a fatigue life in the long transverse direction of at least $1.25\times10^5$ cycles at 35 ksi.

36. The improvement in accordance with claim 35 wherein the thick plate of step (b) has a fatigue life in the range of $1.25\times10^5$ to $2\times10^6$ cycles at 35 ksi and a cumulative failure of up to about 50%.

37. A method of producing an aircraft structural member having a fatigue life in the long transverse direction of at least $1.25\times10^5$ cycles at 35 ksi, said method comprising:

(a) providing a body of an aluminum base alloy comprising: about 1 to 3 wt. % Cu, about 0.9 to 2.85 wt. % Mg, about 1 to 9.5 wt. % Zn, max. 0.5 wt. % Si, max. 0.5 wt. % Fe, max. 0.5 wt. % Mn, max. 0.3 wt. % Cr, max. 0.3 wt. % Zr;

(b) working said body in a temperature range of about 600° to 900° F. by a forging operation which reduces said body at least 30% in a C direction, said forging operation including two or more reduction passes, the first of which reduces body thickness by about 10 to 60%; and (c) rolling said body starting in a temperature range of about 500° to 900° F. to provide a further reduction in thickness in the C direction of about 5 to 75% and produce a thick plate from which said structural member is produced.

38. The method in accordance with claim 37 wherein the thick plate of step (c) has a fatigue life in the range of $1.25\times10^5$ to $2\times10^6$ cycles at 35 ksi and a cumulative failure of up to about 50%.

39. A method of producing a thick plate product having a fatigue life in the long transverse direction of at least $1.25\times10^5$ cycles at 35 ksi, said method comprising:

(a) providing a body of an aluminum base alloy comprising: about 1 to 3 wt. % Cu, about 0.9 to 2.85 wt. % Mg, about 1 to 9.5 wt. % Zn, max. 0.5 wt. % Si, max. 0.5 wt. % Fe, max. 0.5 wt. % Mn, max. 0.3 wt. % Cr, max. 0.3 wt. % Zr;

(b) working said body in a temperature range of about 600 to 900° F. by a forging operation which reduces said body at least 30% in a C direction, said forging proceeding in two or more passes to progressively squeeze the body in said C direction, the percent reduction in one of the passes being greater than the others; and (c) rolling the forged body starting in a temperature range of about 500° to 900° F. to provide a further reduction in thickness in the C direction of about 5 to 75%.

40. The method in accordance with claim 39 wherein said plate product has a fatigue life in the range of $5\times10^5$ to $2\times10^6$ cycles at 35 ksi and a cumulative failure of up to about 50%.

41. The method in accordance with claim 39 wherein the first pass produces the deepest pass and reduces the thickness of the body by about 10 to 40%.

42. A method of producing a thick plate product having a fatigue life in the long transverse direction of at least $1.25\times10^5$ cycles at 35 ksi, said method comprising:

(a) providing a body of an aluminum base alloy comprising: about 1 to 3 wt. % Cu, about 0.9 to 2.85 wt. % Mg, about 5 to 8.5 wt. % Zn, max. 0.5 wt. % Si, max. 0.5 wt. % Fe, max. 0.5 wt. % Mn, 0.05 to 0.3 wt. % Zr;

(b) working said body in a temperature range of about 600°to 900° F. by a forging operation which reduces said body at least 30% in a C direction, said forging proceeding in two or more passes to progressively squeeze the body in said C direction, the percent reduction in one of the passes being greater than the others; and (c) rolling the forged body starting in a temperature range of about 500°to 900° F. to provide a further reduction in thickness in the C direction of about 5 to 75%.

43. The method in accordance with claim 42 wherein said plate product has a fatigue life in the range of $1.25\times10^5$ to $2\times10^6$ cycles at 35 ksi and a cumulative failure of up to about 50%.

44. The method in accordance with claim 42 wherein a first pass produces the deepest pass and reduces the thickness of the body by about 10 to 40%.

45. In a method of producing an aircraft structural member from thick aluminum alloy plate, the improvement wherein said plate is provided as an alloy body comprising: about 1 to 3 wt. % Cu, about 0.9 to 2.85 wt. % Mg, about 5 to 8.5 wt. % Zn, max. 0.5 wt. % Si, max. 0.5 wt. % Fe, max. 0.5 wt. % Mn, max. 0.3 wt. % Cr, max. 0.3 wt. % Zr, and said body is subjected to:

(a) working in a temperature range of about 600° to 900° F. by a forging operation which reduces said body at least 30% in a C direction, said forging proceeding in two or more passes to progressively squeeze the body in said C direction, the percent reduction in one of the passes being greater than the others; and (b) rolling starting in a temperature range of about 500° to 900° F. to provide a further reduction in thickness in the C direction of about 5 to 75% and produce a thick plate which has, after solution heat treating, quenching and aging, a fatigue life in the long transverse direction of at least $1.25\times10^5$ cycles at 35 ksi.

46. The improvement in accordance with claim 45 wherein the thick plate of step (b) has a fatigue life in the range of $1.25\times10^5$ to $2\times10^6$ cycles at 35 ksi and a cumulative failure of up to about 50%.

47. The improvement in accordance with claim 45 wherein a first pass produces the deepest pass and reduces the thickness of the body by about 10 to 40%.

48. In a method of producing an aircraft structural member from thick aluminum alloy plate, the improvement wherein said plate is provided as an alloy body comprising: about 1 to 3 wt. % Cu, about 0.9 to 2.85 wt. % Mg, about 8 to 9.5 wt. % Zn, max. 0.5 wt. % Si, max. 0.5 wt. % Fe, max. 0.5 wt. % Mn, max. 0.3 wt. % Cr, max. 0.3 wt. % Zr, and said body is subjected to:

(a) working in a temperature range of about 600° to 900° F. by a forging operation which reduces said body at least 30% in a C direction, said forging proceeding in two or more passes to progressively squeeze the body in said C direction, the percent reduction in one of the passes being greater than the others; and (b) rolling to produce a thick plate which has, after solution heat treating, quenching and aging, a fatigue life in the long transverse direction equivalent to at least $1.25\times10^5$ cycles at 35 ksi, as measured by ASTM test method E-466, at a cumulative failure of 5%.

49. The improvement in accordance with claim 48 wherein the thick plate of step (b) has a fatigue life in the range of $1.25\times10^5$ to $2\times10^6$ cycles at a cumulative failure of up to about 50%.

50. The improvement in accordance with claim 48 wherein a first pass produces the deepest pass and reduces the thickness of the body by about 10 to 40%.

51. In a method of producing an aircraft structural member from thick aluminum alloy plate, the improvement wherein said plate is provided as an alloy body comprising: about 1 to 3 wt. % Cu, about 0.9 to 2.85 wt. % Mg, about 1 to 9.5 wt. % Zn, max. 0.5 wt. % Si, max. 0.5 wt. % Fe, max. 0.5 wt. % Mn, max. 0.3 wt. % Cr, max. 0.3 wt. % Zr, and said body is subjected to:

(a) working in a temperature range of about 600° to 900° F. by a forging operation which reduces said body at least 30% in a C direction, said forging proceeding in two or more passes to progressively squeeze the body in said C direction, the percent reduction in one of the passes being greater than the others; and (b) rolling starting in a temperature range of about 500° to 900 ° F. to provide a further reduction in thickness in the C direction of about 5 to 75% and produce a thick plate.

52. The improvement in accordance with claim 51 wherein the thick plate of step (b) has a fatigue life in the range of $1.25\times10^5$ to $2\times10^6$ cycles at 35 ksi and a cumulative failure of up to about 50%.

53. The improvement in accordance with claim 51 wherein a first pass produces the deepest pass and reduces the thickness of the body by about 10 to 40%.

54. A thick forged and rolled plate product comprised of an aluminum base alloy comprising about 1 to 3 wt. % Cu, about 0.9 to 2.85 wt. % Mg, about 1 to 9.5 wt. % Zn, max. 0.5 wt.% Si, max. 0.5 wt. % Fe, max. 0.5 wt. % Mn, max. 0.3 wt. % Cr, max. 0.3 wt. % Zr, said plate product, in the solution heat treated, quenched and aged condition, having a fatigue life in the long transverse direction equivalent to at least $1.25\times10^5$ cycles at 35 ksi and a cumulative failure of 5% as measured by ASTM test method E-466.

55. The plate product in accordance with claim 54 wherein said fatigue life is in the range of $1.25\times10^5$ to $2\times10^6$ cycles at 35 ksi and a cumulative failure of up to about 50%.

56. The plate product in accordance with claim 54 which has a thickness of about 4 to 10 inches.

57. The plate product in accordance with claim 54 wherein the Zn content of the base alloy is in the range of about 5 to 8.5 wt. %.

58. The plate product in accordance with claim 54 wherein the Zn content of the base alloy is in the range of about to 9.5 wt. %.

59. A thick forged and rolled plate product comprised of an aluminum base alloy comprising: about 1 to 3 wt. % Cu, about 0.9 to 2.85 wt. % Mg, about 5 to 9.5 wt. % Zn, max. 0.5 wt. % Si, max. 0.5 wt. % Fe, max. 0.5 wt. % Mn, max. 0.3 wt. % Cr, max. 0.3 wt. % Zr, said plate product, in the solution heat treated, quenched and aged condition, having a fatigue life in the long transverse direction equivalent to at least $1.25\times10^5$ cycles at 5 ksi and a cumulative failure of 5% as measured by ASTM test method E 466.

60. The plate product in accordance with claim 59 wherein said fatigue life is in the range of $1.25\times10^5$ to $2\times10^6$ cycles at 35 ksi and a cumulative failure of up to about 50%.

61. A thick forged and rolled plate product comprised of an aluminum base alloy comprising: about 1 to 3 wt. % Cu, 0.9 to 2.85 wt. % Mg, about 8 to 9.5 wt. % Zn, max. 0.5 wt. % Si, max. 0.5 wt. % Fe, max. 0.5 wt. % Mn, max. 0.3 wt. % Cr, max. 0.3 wt. % Zr, said plate product, in the solution heat treated, quenched and aged condition, having a fatigue life in the long transverse direction equivalent to at least $1.25\times10^5$ cycles at 35 ksi and a cumulative failure of 5% as measured by ASTM test method E-466.

62. The plate product in accordance with claim 61 wherein said fatigue life is in the range of $1.25\times10^5$ to $2\times10^6$ cycles at 35 ksi and a cumulative failure of up to about 50%.

63. A forged and rolled plate product: having a thickness in the range of about 6 to 10 inches; having been produced from an aluminum base alloy comprising: about 1 to 3 wt. % Cu, about 0.9 to 2.85 wt. % Mg, about 1 to 9.5 wt. % Zn, max. 0.5 wt. % Si, max. 0.5 wt. % Fe, max. 0.5 wt. % Mn, max. 0.3 wt. % Cr, max. 0.3 wt. % Zr; said plate product, in the solution heat treated, quenched and aged condition, having a fatigue life in the long transverse direction equivalent to at least $1.25\times10^5$ cycles at 35 ksi and a cumulative failure of 5% as measured by ASTM test method E-466.

64. The plate product in accordance with claim 63 wherein said fatigue life is in the range of $1.25\times10^5$ to $2\times10^6$ cycles at 35 ksi and a cumulative failure of up to about 50%.

65. The plate product in accordance with claim 63 wherein the Zn content of the alloy is in the range of about 5 to 8.5 wt. %.

66. The plate product in accordance with claim 63 wherein the Zn content of the alloy is in the range of about 8 to 9.5 wt. %.

67. A forged and rolled plate product: having a thickness in the range of about 6 to 10 inches; having been produced from an aluminum base alloy comprising: about 1 to 3 wt. % Cu, about 0.9 to 2.85 wt. % Mg, about 5 to 9.5 wt. % Zn, max. 0.5 wt. % Si, max. 0.5 wt. % Fe, max. 0.5 wt. % Mn, max. 0.3 wt. % Cr, max. 0.3 wt. % Zr; said plate product, in the solution heat treated, quenched and aged condition, having a fatigue life in the long transverse direction equivalent to at least $1.25\times10^5$ cycles at 35 ksi and a cumulative failure of 5% as measured by ASTM test method E-466.

68. The plate product in accordance with claim 67 wherein said fatigue life is in the range of $1.25\times10^5$ to $2\times10^6$ cycles at 35 ksi and a cumulative failure of up to about 50%.

69. A thick plate product having been forged in two or more reduction passes from an aluminum base alloy comprising: about 1 to 3 wt. % Cu, about 0.9 to 2.85 wt. % Mg, about 1 to 9.5 wt. % Zn, max. 0.5 wt. % Si, max. 0.5 wt. % Fe, max. 0.5 wt. % Mn, max. 0.3 wt. % Cr, max. 0.3 wt. % Zr, said plate product, in the solution heat treated, quenched and aged condition, having a fatigue life in the long transverse direction equivalent to at least $1.25\times10^5$ cycles at 35 ksi and a cumulative failure of 5% as measured by ASTM test method E-466.

70. The plate product in accordance with claim 69 wherein said fatigue life is in the range of $1.25\times10^5$ to $2\times10^6$ cycles at 35 ksi and a cumulative failure of up to about 50%.

71. The plate product in accordance with claim 69 which has a thickness of about 4 to 10 inches.

72. The plate product in accordance with claim 69 wherein the Zn content of the alloy is in the range of about 5 to 8.5 wt. %.

73. The plate product in accordance with claim 69 wherein the Zn content of the alloy is in the range of about 8 to 9.5 wt. %.

74. A thick plate product having been forged in two or more reduction passes from an aluminum base alloy comprising: about 1 to 3 wt. % Cu, about 0.9 to 2.85 wt. % Mg, about 5 to 9.5 wt. % Zn, max. 0.5 wt. % Si, max. 0.5 wt. % Fe, max. 0.5 wt. % Mn, max. 0.3 wt. % Cr, max. 0.3 wt. % Zr, said plate product, in the solution heat treated, quenched and aged condition, having a fatigue life in the long transverse direction equivalent to at least $1.25\times10^5$ cycles at 35 ksi and a cumulative failure of 5% as measured by ASTM test method E-466.

75. The plate product in accordance with claim 74 wherein said fatigue life is in the range of $1.25\times10^5$ to $2\times10^6$ cycles at 35 ksi and a cumulative failure of up to about 50%.

76. A thick plate product having been forged in two or more reduction passes from an aluminum base alloy comprising: about 1 to 3 wt. % Cu, about 0.9 to 2.85 wt. % Mg, about 8 to 9.5 wt. % Zn, max. 0.5 wt. % Si, max. 0.5 wt. % Fe, max. 0.5 wt. % Mn, max. 0.3 wt. % Cr, max. 0.3 wt. % Zr, said plate product, in the solution heat treated, quenched and aged condition, having a fatigue life in the long transverse direction equivalent to at least $1.25\times10^5$ cycles at 35 ksi and a cumulative failure of 5% as measured by ASTM test method E-466.

77. The plate product in accordance with claim 76 wherein said fatigue life is in the range of $1.25\times10^5$ to $2\times10^6$ cycles at 35 ksi and a cumulative failure of less than 5%.

78. An aircraft structural member produced from a thick forged and rolled plate made from an aluminum base alloy comprising: about 1 to 3 wt. % Cu, about 0.9 to 2.85 wt. % Mg, about 1 to 9.5 wt. % Zn, max. 0.5 wt. % Si, max. 0.5 wt. % Fe, max. 0.5 wt. % Mn, max. 0.3 wt. % Cr, max. 0.3 wt. % Zr, said plate, in the solution heat treated, quenched and aged condition, having a fatigue life in the long transverse direction equivalent to at least $1.25\times10^5$ cycles at a cumulative failure of 5% as measured by ASTM test method E-466.

79. The member in accordance with claim 78 wherein said plate has a fatigue life in the range of $1.25\times10^5$ to $2\times10^6$ cycles at 35 ksi and a cumulative failure of up to about 50%.

80. An aircraft structural member produced from a thick forged and rolled plate made from an aluminum base alloy comprising: about 1 to 3 wt. % Cu, about 0.9 to 2.85 wt. % Mg, about 5 to 9.5 wt. % Zn, max. 0.5 wt. % Si, max. 0.5 wt. % Fe, max. 0.5 Wt. % Mn, max. 0.3 wt. % Cr, max. 0.3 wt. % Zr, said plate, in the solution heat treated, quenched and aged condition, having a fatigue life in the long transverse direction equivalent to at least $1.25\times10^5$ cycles at 35 ksi and a cumulative failure of 5% as measured by ASTM test method E-466.

81. The member in accordance with claim 80 wherein said plate has a fatigue life in the range of $1.25\times10^5$ to $2\times10^6$ cycles at 35 ksi and a cumulative failure of up to about 50%.

82. An aircraft structural member produced from a thick forged and rolled plate made from an aluminum base alloy comprising: about 1 to 3 wt. % Cu, about 0.9 to 2.85 wt. % Mg, about 8 to 9.5 % An, max. 0.5 wt. % Si, max. 0.5 wt. % Fe, max. 0.5 wt. % Mn, max. 0.3 wt. % Cr, max. 0.3 wt. % Zr, said plate, in the solution heat treated, quenched and aged condition, having a fatigue life in the long transverse direction equivalent to at least $1.25\times10^5$ cycles at 35 ksi and a cumulative failure of 5% as measured by ASTM test method E-466.

83. The member in accordance with claim 82 wherein said plate has a fatigue life in the range of $1.25\times10^5$ to $2\times10^6$ cycles at 35 ksi and a cumulative failure of up to about 50%.

84. An airplane or airplane subassembly comprising a part made from thick aluminum plate, said plate being produced by the method comprising:

(a) providing a body of an aluminum base alloy comprising: about 1 to 3 wt. % Cu, about 0.9 to 2.85 wt. % Mg, about 5 to 8.5 wt. % Zn, max. 0.5 wt. % Si, max. 0.5 wt. % Fe, max. 0.5 wt. % Mn, 0.05 to 0.3 wt. % Zr;

(b) forging to squeeze said body and reduce its thickness by at least 30% in a C direction; and (c) rolling said body.

85. The airplane or airplane subassembly according to claim 84 wherein said forging of step (b) results in a total reduction of at least 40%.

86. The airplane or airplane subassembly according to claim 84 wherein said rolling of step (c) reduces body thickness by at least 5%.

87. An airplane or airplane subassembly comprising a part made from thick plate, said plate comprised of an aluminum base alloy comprising: about 1 to 3 wt. % Cu, about 0.9 to 2.85 wt. % Mg, about 5 to 9.5 wt. % Zn, max. 0.5 wt. % Si, max. 0.5 wt. % Fe, max. 0.5 wt. % Mn, max. 0.3 wt. % Cr, max. 0.3 wt. % Zr, and said plate, in the solution heat treated, quenched and aged condition, having a fatigue life in the long transverse direction equivalent to at least $1.25\times10^5$ cycles at 35 ksi and a cumulative failure of 5% as measured by ASTM test method E-466.

88. The airplane or airplane subassembly according to claim 87 wherein said plate is 4 to 10 inches thick.

89. The airplane or airplane subassembly according to claim 87 wherein said plate is made from one of the alloys selected from AA7049, 7149, 7050, 7150, 7064, 7075, 7175, 7475, 7076 and 7178.

90. The method in accordance with claim 1 wherein the dimension of said body in the C direction is reduced about 35-65% by the forging of step (b).

91. The method in accordance with claim 1 wherein the dimension of said body in the C direction is reduced at least about 40% by the forging of step (b).

92. The method in accordance with claim 8 wherein the thickness of said body in the C direction is reduced about 35-65% by the forging of step (b).

93. The method in accordance with claim 8 wherein the thickness of said body in the C direction is reduced at least about 40% by the forging of step (b).

94. The method in accordance with claim 9 wherein the forging operation of step (b) reduces said body in the C direction about 35-65%.

95. The method in accordance with claim 9 wherein the forging operation of step (b) reduces said body in the C direction at least about 40%.

96. The method in accordance with claim 10 wherein the forging operation of step (b) reduces said body in the C direction about 35-65%.

97. The method in accordance with claim 10 wherein the forging operation of step (b) reduces said body in the C direction at least about 40%.

98. The method in accordance with claim 11 wherein the forging operation of step (b) reduces said body in the C direction about 35-65%.

99. The method in accordance with claim 11 wherein the forging operation of step (b) reduces said body in the C direction at least about 40%.

100. The method in accordance with claim 13 wherein the forging operation of step (b) reduces said body in the C direction about 35-65%.

101. The method in accordance with claim 13 wherein the forging operation of step (b) reduces said body in the C direction at least about 43%.

102. The method in accordance with claim 18 wherein the forging operation of step (b) reduces said body in the C direction about 35-65%.

103. The method in accordance with claim 18 wherein the forging operation of step (b) reduces said body in the C direction at least about 43%.

104. The improvement in accordance with claim 19 wherein the forging operation of step (a) reduces said body in the C direction about 35-65%.

105. The improvement in accordance with claim 19 wherein the forging operation of step (a) reduces said body in the C direction at least about 40%.

106. The improvement in accordance with claim 21 wherein the forging operation of step (a) reduces said body in the C direction about 35-65%.

107. The improvement in accordance with claim 21 wherein the forging operation of step (a) reduces said body in the C direction at least about 40%.

108. The improvement in accordance with claim 23 wherein the forging operation of step (a) reduces said body in the C direction about 35-65%.

109. The improvement in accordance with claim 23 wherein the forging operation of step (a) reduces said body in the C direction at least about 40%.

110. The improvement in accordance with claim 31 wherein the forging operation of step (a) reduces said body in the C direction about 35-65%.

111. The improvement in accordance with claim 31 wherein the forging operation of step (a) reduces said body in the C direction at least about 40%.

112. The improvement in accordance with claim 33 wherein the forging operation of step (a) reduces said body in the C direction about 35-65%.

113. The improvement in accordance with claim 33 wherein the forging operation of step (a) reduces said body in the C direction at least about 40%.

114. The improvement in accordance with claim 35 wherein the forging operation of step (a) reduces said body in the C direction about 35-65%.

115. The improvement in accordance with claim 35 wherein the forging operation of step (a) reduces said body in the C direction at least about 40%.

116. The method in accordance with claim 37 wherein the forging operation of step (b) reduces said body in the C direction about 35-65%.

117. The method in accordance with claim 37 wherein the forging operation of step (b) reduces said body in the C direction at least about 40%.

118. The method in accordance with claim 39 wherein the forging operation of step (b) reduces said body in the C direction about 35-65%.

119. The method in accordance with claim 39 wherein the forging operation of step (b) reduces said body in the C direction at least about 43%.

120. The method in accordance with claim 42 wherein the forging operation of step (b) reduces said body in the C direction about 35-65%.

121. The method in accordance with claim 42 wherein the forging operation of step (b) reduces said body in the C direction at least about 40%.

122. The improvement in accordance with claim 45 wherein the forging operation of step (a) reduces said body in the C direction about 35-65%.

123. The improvement in accordance with claim 45 wherein the forging operation of step (a) reduces said body in the C direction at least about 40%.

124. The improvement in accordance with claim 48 wherein the forging operation of step (a) reduces said body in the C direction about 35-65%.

125. The improvement in accordance with claim 48 wherein the forging operation of step (a) reduces said body in the C direction at least about 40%.

126. The improvement in accordance with claim 51 wherein the forging operation of step (a) reduces said body in the C direction about 35-65%.

127. The improvement in accordance with claim 51 wherein the forging operation of step (a) reduces said body in the C direction at least about 40%.

128. The airplane or airplane subassembly according to claim 84 wherein said forging of step (b) results in a total reduction of about 35-65%.

129. The method in accordance with claim 1 wherein said alloy includes less than about 0.06 wt. % Fe.

130. The method in accordance with claim 1 wherein said alloy includes less than about 0.04 wt. % Si.

131. The method in accordance with claim 8 wherein said alloy includes less than about 0.06 wt. % Fe and less than about 0.04 wt. % Si.

132. The method in accordance with claim 131 wherein said alloy includes about 0.01-0.05 wt. % Fe and about 0.01-0.03 wt. % Si.

133. The method in accordance with claim 9 wherein said alloy includes less than about 0.06 wt. % Fe and less than about 0.04 wt. % Si.

134. The method in accordance with claim 133 wherein said alloy includes about 0.01-0.05 wt. % Fe and about 0.01-0.03 wt. % Si.

135. The method in accordance with claim 10 wherein said alloy includes about 0.01-0.05 wt. % Fe.

136. The method in accordance with claim 10 wherein said alloy includes about 0.01-0.03 wt. % Si.

137. The method in accordance with claim 11 wherein said alloy includes less than about 0.06 wt. % Fe and less than about 0.04 wt. % Si.

138. The method in accordance with claim 137 wherein said alloy includes about 0.01-0.05 wt. % Fe and about 0.01-0.03 wt. % Si.

139. The method in accordance with claim 13 wherein said alloy includes less than about 0.06 wt. % Fe and less than about 0.04 wt. % Si.

140. The method in accordance with claim 139 wherein said alloy includes about 0.01-0.05 wt. % Fe and about 0.01-0.03 wt. % Si.

141. The method in accordance with claim 18 wherein said alloy includes less than about 0.06 wt. % Fe and less than about 0.04 wt. % Si.

142. The method in accordance with claim 141 wherein said alloy includes about 0.01-0.05 wt. % Fe and about 0.01-0.03 wt. % Si.

143. The improvement in accordance with claim 19 wherein said alloy body includes less than about 0.06 wt. % Fe and less than about 0.04 wt. % Si.

144. The improvement in accordance with claim 143 wherein said alloy body includes about 0.01-0.05 wt. % Fe and about 0.01-0.03 wt. % Si.

145. The improvement in accordance with claim 21 wherein said alloy body includes less than about 0.06 wt. % Fe and less than about 0.04 wt. % Si.

146. The improvement in accordance with claim 145 wherein said alloy body includes about 0.01-0.05 wt. % Fe and about 0.01-0.03 wt. % Si.

147. The improvement in accordance with claim 23 wherein said alloy body includes less than about 0.06 wt. % Fe and less than about 0.04 wt. % Si.

148. The improvement in accordance with claim 147 wherein said alloy body includes about 0.01-0.05 wt. % Fe and about 0.01-0.03 wt. % Si.

149. The improvement in accordance with claim 31 wherein said alloy body includes less than about 0.06 wt. % Fe and less than about 0.04 wt. % Si.

150. The improvement in accordance with claim 149 wherein said alloy body includes about 0.01-0.05 wt. % Fe and about 0.01-0.03 wt. % Si.

151. The improvement in accordance with claim 33 wherein said alloy body includes less than about 0.06 wt. % Fe and less than about 0.04 wt. % Si.

152. The improvement in accordance with claim 151 wherein said alloy body includes about 0.01-0.05 wt. % Fe and about 0.01-0.03 wt. % Si.

153. The improvement in accordance with claim 35 wherein said alloy body includes less than about 0.06 wt. % Fe.

154. The improvement in accordance with claim 35 wherein said alloy body includes less than about 0.04 wt. % Si.

155. The method in accordance with claim 37 wherein said alloy includes less than about 0.06 wt. % Fe and less than about 0.04 wt. % Si.

156. The method in accordance with claim 155 wherein said alloy includes about 0.01-0.05 wt. % Fe and about 0.01-0.03 wt. % Si.

157. The method in accordance with claim 39 wherein said alloy includes less than about 0.06 wt. % Fe and less than about 0.04 wt. % Si.

158. The method in accordance with claim 157 wherein said alloy includes about 0.01-0.05 wt. % Fe and about 0.01-0.03 wt. % Si.

159. The method in accordance with claim 42 wherein said alloy includes less than about 0.06 wt. % Fe and less than about 0.04 wt. % Si.

160. The method in accordance with claim 159 wherein said alloy includes about 0.01-0.05 wt. % Fe and about 0.01-0.03 wt. % Si.

161. The improvement in accordance with claim 45 wherein said alloy body includes less than about 0.06 wt. % Fe and less than about 0.04 wt. % Si.

162. The improvement in accordance with claim 161 wherein said alloy body includes about 0.01-0.05 wt. % Fe and about 0.01-0.03 wt. % Si.

163. The improvement in accordance with claim 48 wherein said alloy body includes less than about 0.06 wt. % Fe and less than about 0.04 wt. % Si.

164. The improvement in accordance with claim 163 wherein said alloy body includes about 0.01–0.05 wt. % Fe and about 0.01–0.03 wt. % Si.

165. The improvement in accordance with claim 51 wherein said alloy body includes less than about 0.06 wt. % Fe and less than about 0.04 wt. % Si.

166. The improvement in accordance with claim 165 wherein said alloy body includes about 0.01–0.05 wt. % Fe and about 0 01–0.03 wt. % Si.

* * * * *

UNITED STATES PATENT AND TRADEMARK OFFICE

CERTIFICATE OF CORRECTION

PATENT NO. : 5,277,719

DATED : January 11, 1994

INVENTOR(S) : G. William Kuhlman et al

It is certified that error appears in the above-identified patent and that said Letters Patent is hereby corrected as shown below:

| | |
|---|---|
| Col. 4, line 66 | Change "1/4" to --1/2-- |
| Col. 10, line 64 (Claim 40) | Delete "5" and insert --1.25-- |
| Col. 12, line 62 (Claim 58) | After "about", insert --8-- |
| Col. 13, line 3 (Claim 59) | Change "5 ksi" to --35 ksi-- |
| Col. 13, line 11 (Claim 61) | Insert --about-- after "about 1 to 3 wt.% Cu," |

Signed and Sealed this

First Day of November, 1994

*Attest:*

*Attesting Officer*

Bruce Lehman

BRUCE LEHMAN

*Commissioner of Patents and Trademarks*